US005913788A

United States Patent [19]

Herren

[11] Patent Number: 5,913,788

[45] Date of Patent: Jun. 22, 1999

[54] FIRE BLOCKING AND SEISMIC RESISTANT WALL STRUCTURE

[76] Inventor: Thomas R. Herren, 6855 Jimmy Carter Blvd., Suite 2150, Norcross, Ga. 30071

[21] Appl. No.: 08/905,230

[22] Filed: Aug. 1, 1997

[51] Int. Cl.[6] ..... E04B 1/94; E04B 2/28

[52] U.S. Cl. ..... 52/241; 52/236.7; 52/481.1

[58] Field of Search ..... 52/262, 336, 221, 52/450, 576, 577, 503, 241, 334, 243, 236.7, 236.9, 265, 267, 481.1, 483.1

[56] References Cited

U.S. PATENT DOCUMENTS

| | | | |
|---|---|---|---|
| 4,106,249 | 8/1978 | Morton . | |
| 5,113,631 | 5/1992 | DiGirolamo | 52/262 X |
| 5,127,203 | 7/1992 | Paquette . | |
| 5,127,760 | 7/1992 | Brady . | |
| 5,467,566 | 11/1995 | Swartz et al. . | |
| 5,737,895 | 4/1998 | Perrin | 52/236.9 |
| 5,755,066 | 5/1998 | Becker | 52/481.1 |

OTHER PUBLICATIONS

Sweets Catalog File, 1985, Seebion 6.6/sim. pp. 23–24.

*Primary Examiner*—Michael Safavi
*Attorney, Agent, or Firm*—Charles H. Thomas

[57] ABSTRACT

An interior building wall construction is achieved which is superior in its combined capabilities for resistance to both seismic activity and fire. The head-of-wall construction at the interface between an interior building wall employing sheet metal framing and a ceiling thereabove exceeds even the most stringent building code requirements for fire and seismic resistance. Seismic resistance is achieved by providing the beam at the top of the wall with slots elongated in a longitudinal direction in the web of the beam and with vertically elongated slots in the side walls of the beam. Standoff washers are provided in the elongated slots and the ceiling fasteners and stud fasteners employed extend through these standoff washers to securely join the studs, beam, and ceiling above together, yet permit limited relative movement therebetween when the building is subjected to seismic activity. Superior fire resistance is achieved by employing an economical, fire resistant, resiliently compressible, sponge-like mineral fiber insulation in any cavities above the beam and along the top of the wall. Strips of this mineral fiber insulation material are held in place along the top of the wall by providing a double thickness of wallboard at the head-of-wall in which an outer, secondary layer of wallboard material overlies and projects vertically beyond an underlying primary wallboard panel. A gap is left at the tops of both of the layers of wallboard so that strips of the mineral fiber insulation can be packed into these gaps between the wallboard and the ceiling and will remain in position without any type of adhesive or other fastening system. The beam of the head-of-wall is die cut to form anchoring tabs that can be bent upwardly into sections of mineral fiber located in one or more tunnels formed by the flutes of decking above the wall.

17 Claims, 6 Drawing Sheets

FIRE BLOCKING AND SEISMIC RESISTANT WALL STRUCTURE

BACKGROUND OF THE INVENTION

1. Field of the Invention

The present invention relates to a system for constructing interior building walls that will withstand both seismic activity and fire.

2. Description of the Prior Art

Seismic and fire resistance has become of increasing concern in building construction. In the construction of buildings the framework for the walls of a building is formed of horizontal sill members at the floor, at the ends of which vertical corner posts support horizontal beams at the ceiling level. Between the corner posts there are upright supports, called studs, laterally spaced, usually at uniform intervals, to provide the necessary interior structural support for the wall.

Historically, the framework of a building wall was formed entirely of wooden members, including wooden studs. In recent years, however, the use of metal studs has gained increased acceptance, especially in the construction of commercial buildings, such as office buildings, schools, and hospitals. It has been found that metal studs can be employed to advantage, since a suitable metal, such as twenty-gauge galvanized steel, is stronger than wood, and therefore offers greater resistance to seismic forces. Moreover, metal studs will not burn as wood does, will not rot, and are not subject to damage by pests, such as termites. The use of metal studs also reduces the depletion of hardwood forests. Furthermore, metal studs are now economically competitive with wooden studs in the building construction industry.

While wooden studs are formed of solid wood, typically having nominal cross section dimensions of two inches by four inches, the much greater structural strength of metal allows building studs to be employed which are not solid, but rather are hollow and have a channel or "C-shaped" cross section. To conform to the architectural plans and building materials which have been developed over the years based on the use of wooden studs having specific cross sectional dimensions, commercially available metal studs are constructed with the same outer dimensions in which wooden studs have been manufactured for many years. Specifically, metal studs are typically formed of sheet metal bent to encompass a cross sectional area having nominal dimensions of two inches by four inches.

For ease of fabrication the metal studs are formed of sheet metal bent into a generally "U-shaped" cross section and in which a relatively broad central web is flanked by a pair of narrower sides that are bent at right angles to the web or base. The web typically has a uniform nominal width of either four inches or three and one half inches, and the sides of the U-shaped stud typically extend a nominal distance of two inches from the web. To enhance structural rigidity the edges of the sides of the metal stud are normally bent over into a plane parallel to and spaced from the plane of the web. These turned over edges of the side walls thereby form marginal lips which are typically one quarter to one half an inch in width. The finished stud therefore has a generally "C-shaped" cross section.

The overhead beams that extend along the tops of the studs in interior building wall construction have a U-shaped configuration. They are each formed with a horizontally disposed web from which a pair of side walls depend vertically on opposite sides of the web. The side walls embrace the sides of the vertical studs so that the upper extremities of the studs extend perpendicular into the concave, downwardly facing channel formed by the overhead beam. The spacing of the studs along the length of the beam is typically either sixteen or twenty-four inches. In a nonload-bearing wall the web of the beam is secured to the ceiling above by screws that extend vertically upwardly through the web of the beam and into the structure of the ceiling.

One problem which occurs in any building during an earthquake is that the seismic ground motion produced by an earthquake creates both horizontal and vertical undulations in the building. The elongated, vertical lengths of metal studs in building wall construction render these studs limber enough to flex sufficiently in a lateral direction and thereby resist inelastic deformation during an earthquake. However, vertical undulations that vary the distance between the floor and ceiling in a room during an earthquake are more likely to destroy, or at least damage the integrity, of the structural joints between vertical metal studs and horizontal sill and overhead beam members between which the studs extend in a building.

To alleviate this problem a seismic and fire resistant wall structure and method was devised. This system is described in U.S. Pat. No. 5,127,203. According to this system the overhead beam that extends across the top of the upright studs is provided with vertically elongated slots which are longitudinally spaced at intervals to accommodate the positions of studs within a vertical, nonload-bearing wall. Fasteners extend through the vertically elongated slots in the overhead beams and into the sides of the studs. The fasteners, typically sheet metal screws, are tight enough to provide lateral stability at the joints between the studs and the overhead beam, but are not so tight as to totally prevent relative vertical motion therebetween.

As vertical undulations from an earthquake are transmitted through the structural components of a nonload-bearing wall, the elongated, vertical slots through which the studs fasteners extend permit limited, vertical, oscillatory motion to occur between the upper extremities of the studs and the overhead beams of the nonload-bearing walls. As a result, the stud fasteners maintain structural integrity so that the wall remains undamaged and does not require repair following an earthquake.

Another consideration which also is of great concern in building construction is the resistance to fire. In the conventional construction of nonload-bearing walls employing metal studs, sills, and overhead beams, the metal members, of course, are fire resistant. Furthermore, fire-resistant wallboard is attached to the opposing side faces of the studs and extends between the floor and the channel-shaped beam member. The nonload-bearing, interior walls thereby form a fire block and create a vertical barrier to the spread of a fire. However, one problem which has not heretofore been adequately dealt with is the matter of fire resistance at the interfaces between the overhead beams atop the metal studs and the ceiling to which the beams are connected.

In a typical building construction a ceiling is formed by galvanized steel, fluted decking atop which a layer of concrete is poured to form the floor above. The fluted steel decking may, for example, be eighteen gauge galvanized steel. The flutes, or concave, downwardly facing channels defined in the underside of the decking, are typically about three inches deep and either four or six inches wide. Interior walls often pass transversely across the flutes, and the beams at the tops of such walls are attached to the underside of the decking where the decking projects downwardly between the hollow flutes. Openings having cross-sectional areas equal to the areas of the flutes are thereby formed above the beams that are located at the top of nonload-bearing, interior walls. These openings form lateral tunnels across the tops of the walls through which fire can travel unless blocked.

To prevent the spread of fire through the flutes formed by the decking above nonload-bearing, interior walls, fire-resistant insulation is packed in the flute openings where these tunnels pass across the top of the walls. A typical, conventional fire insulation material of this type is Monokote MK-6/CBF. This fire-resistant insulation is applied by spraying it into the flute openings from each side of the wall. As long as the insulation remains in the flute openings, these tunnels are blocked and prevent the spread of fire therethrough. However, when a fire is burning within a building, it generates a considerable amount of smoke which is heated and expands. The smoke creates a substantial pressure within a room where a fire is burning. It has been discovered that the pressure of smoke from a fire burning within a room literally blasts the fire insulation out of the flute openings atop the wall. When this occurs the fire can thereupon spread to an adjacent room over the top of the wall through the flute openings.

According to present building construction practice fire insulation is held within the tunnel cavities defined by the flutes of the decking by hand cutting the upper edges of wall panels to follow the corrugations of the decking. The wallboard panels forming the sides of the nonload-bearing walls provide a series of projections that block the flute tunnels from the opposite sides of the wall and thereby hold the insulation in place. However, this method of holding the insulation in position is extremely time consuming, laborious, and expensive.

Hand cutting of the upper region of the wall to follow the convolutions of the corrugated, fluted decking is extremely labor intensive. This adds significantly to the cost of construction of the wall. Moreover, even if a template is used the hand cuts result in significant gaps remaining which must then be caulked. The process of caulking is also an extremely laborious, labor intensive process, particularly when it is necessary to follow the convolutions of the underside of the fluted decking. Moreover, conventional caulking is not seismic resistant. That is, even if the caulking originally provides an effective barrier to air currents, if the building structure subsequently is subjected to seismic activity, the caulking crumbles and gaps that allow the passage of air currents are opened. When this occurs the wall no longer offers its original resistance to the spread of fire. As a result, it has not heretofore been possible to provide both seismic resistance and fire resistance in building walls that will meet the stringent building codes applicable to structures such as schools and hospitals.

A principal object of the present invention is to provide an interior building wall construction that will meet both stringent seismic and fire resistance code standards. For example, the UL (Underwriter's Laboratory) Standard 2079 requires that joints in metal stud framing withstand twenty cycles of a one-half inch linear movement of the structures joined together. The wall system of the present invention successfully withstands cycling of one hundred cycles of one full inch of linear movement. Also, UL Specification 2079 additionally requires the joints of a wall to remain fire resistant for a full hour, in the case of some interior walls, and for two hours in the case of others. After subjecting the wall to fire, the wall joint and the insulation in the cavities of the flutes atop the wall must withstand the pressure applied by a stream of water directed thereon from a firehose to simulate the pressure produced within a building due to fire. In conventional building construction systems the blast from the fire hose readily dislodges the insulation from the cavities created by the flutes above the wall beam unless the wallboard has been cut to follow the undulations of the ceiling flutes and thereby protect the insulation.

In testing building wall systems for fire resistance, the joints are expanded to the maximum joint opening width for which the system is intended to function. Thus, it is evident that design features that tend to enhance seismic resistance tend to reduce fire resistance. That is, if there is considerable play in the joints between upright metal studs and overhead metal beams to which the studs are attached, openings are created which reduce resistance to the passage of fire. One the other hand, if joints are closed and locked immovably together, they are likely to fail when subjected to seismic activity. Thus it has heretofore not been possible to provide an interior building wall construction system which meets both the maximum standards for fire resistance and the maximum standards for resistance to seismic movement as well. However, the system of the present invention easily surpasses both fire and seismic resistance code specifications that are currently in use.

SUMMARY OF THE INVENTION

The system of the present invention employs an insulating material which is not only fireproof, but compressible and resilient as well. Moreover, this material does not become brittle with age. In addition, this same material may be utilized in place of caulking at the upper extremity of the wall adjacent the ceiling above.

The technique that contributes to the successful operation of the wall construction according to the present invention is the use a compressible, nonflammable mineral fiber insulation called safing both above the beams and above the wallboard. This mineral fiber substance is a fireproof material that is produced as a by-product of slag. It is heated and spun and resembles spun fiberglass in texture, although it is dark brown in color. More importantly, it is a spongy, resiliently compressible material that does not become brittle with age, nor with exposure to temperature extremes. Furthermore, it is extremely low in cost.

A primary object of the present invention is to provide a fire and seismic resistant wall construction that maintains its resistance to fire even after being subjected to seismic activity. In conventional interior building wall construction the cavities in the flutes above the nonload-bearing interior wall beams are filled with Monokote insulation as a fire insulating substance. Although Monokote is resistant to fire, it is somewhat brittle even when installed, and becomes more brittle as it ages. As a consequence, if the building is subjected to seismic activity, the metal decking in a floor above a nonload-bearing wall and the wall structure will move relative to each other. This movement causes the Monokote to be crushed in the flute cavities and to crumble and dissipate.

Furthermore, the caulking that is applied to the seams between the wallboard and the fluted metal decking also is somewhat brittle, and crumbles when subjected to seismic activity. As a consequence, conventional building wall structures that have once been subjected to seismic activity thereafter no longer have the resistance to fire that existed at the time of installation. The system of the present invention is far superior to conventional systems in this regard.

The system of the invention also employs a unique technique for anchoring the insulation in position in the flute cavities above the wall beam so that it is entirely unnecessary to cut the wallboard to match the undulations of the ceiling flutes. Rather, the insulation is held in position in the flute cavities by providing the wall beams with die cuts in the beam webs that define anchoring tabs in the web beam. These anchoring tabs are defined at longitudinally spaced intervals along the length of the beam web so that at least some of the tabs are located directly beneath the downwardly facing flutes in the expansive deck member above.

Once the beam is installed and the insulation is in position in the flute cavities above the beam, the anchoring tabs are bent upwardly out of the plane of the beam web by striking them with a hammer or some other implement. The anchoring tabs thereby project upwardly into the resilient, compressible insulating material above to hold that material in position in the flute cavities so that it will withstand even a direct stream of water from a fire hose, as required by applicable testing specifications.

In the building construction industry the structure at the intersection between the top of an interior building wall and the ceiling deck of the floor above is referred to as a head-of-wall. There are a number of regulatory building code provisions specified for head-of-wall requirements.

The head-of-wall system of the present invention is unique in the field of metal stud framing in that it has been cycled and fire tested for head-of-wall design in a manner that surpasses Underwriter's Laboratory Specification 2079. While that specification requires twenty cycles of one-half inch, the system of the present intention has successfully cycled one hundred times at one full inch. Moreover, the same system of the present invention has fire tested for a two hour rating, and has passed the hose stream test of UL Specification 2079 as well.

Moreover, the system of the invention is far more economical to install than systems that employ conventional Monokote insulation. The head of wall according to the present invention can be fireproofed for about a nickel a linear foot, as compared with the cost of insulating and caulking a head-of-wall interface according to conventional techniques, which ranges from thirty dollars to sixty dollars a linear foot.

By utilizing the system of the present invention, all fire caulking, all cut ins for the flutes, and all caulking of the flutes is eliminated. Moreover, no sprayed-on fireproofing is required. The present invention represents the cheapest alternative and at present the only way of meeting the most stringent building codes for head-of-wall design.

In one broad aspect the present invention may be considered to be an improvement is a seismic and fire-resistant interior wall structure installed between a floor and a ceiling. That is, it may be considered to be an improved head-of-wall design.

Such a system includes a plurality of vertical metal studs extending upwardly from the floor and arranged in linear alignment with each other across the floor. Each stud is comprised of a channel formed with opposing upright sides. The system also includes a metal, concave, downwardly facing, channel-shaped beam having a web and having opposing side walls. Vertically elongated, stud fastener openings are defined through the side walls of the beam. The beam side walls depend from the web and the beam extends across the upper ends of the studs. The web of the beam resides in contact with the ceiling above at a short vertical clearance above the studs. The side walls of the beam embrace the upright sides of the studs near their upper ends.

Ceiling fasteners extend through the web of the beam to secure the beam to the ceiling above. Stud fasteners extend through at least some of the stud fastener openings in the side walls of the beam and into the studs to attach the beam to the upper ends of the studs. Primary wallboard wall panels are fastened to and reside in contact with the upright sides of the studs.

In a typical building construction the ceiling is formed of an expansive metal deck member in which a plurality of concave, downwardly facing, channel-shaped flutes are defined. The same insulating material that fills the gaps between the primary wallboard wall panels and the ceiling is used to fill the cavities in the flutes directly above the beams.

To anchor the mineral fiber material in the flute cavities, insulation anchoring tabs are defined in the web of the beam at locations beneath at least one of the downwardly facing flutes of the deck member. The insulation anchoring tabs are inelastically deformed upwardly to extend up into and anchor the insulation relative to the beam.

The insulation anchoring tabs are preferably formed as trapezoidal areas on the web of the beam. Each insulation anchoring tab is die cut along three sides so that the remaining side of the trapezoidal area serves as a base by means of which the tabs remain connected to the structure of the web.

The head-of-wall system of the present invention may be designed for use with walls constructed both to meet a one-hour fire test rating and also walls constructed to meet a two-hour fire test rating. According to the improvement of the invention, primary wallboard gaps exist between the primary wallboard wall panels and the ceiling above. In walls that must meet only a one hour fire test rating secondary wallboard strips are also provided. These wallboard strips are typically about eight inches in width and extend longitudinally along the length of the wall. The secondary wallboard strips reside in contact with and extend upwardly beyond the primary wallboard panels so that secondary wallboard gaps exist between the secondary wallboard strips and the ceiling. These secondary wallboard gaps are narrower than the primary wallboard gaps so as to form elongated, unfilled spaces above the primary wallboard panels and above the secondary wallboard strips having an inverted "L-shaped" cross section. Each of these unfilled spaces forms a "chair" into which an elongated strip of compressible, nonflammable, mineral fiber insulation can be stuffed. This chair will hold the mineral fiber strip in position without the use of adhesives or any other form of attachment.

For a wall to meet the fire testing requirements for a two-hour rating, a double thickness of wallboard must be employed throughout the entire expanse of the wall. Rather than utilizing only a narrow secondary wallboard strip at the head-of-wall, secondary wallboard wall panels are provided on each side of the wall. The secondary wallboard wall panels completely cover the primary wallboard wall panels and are secured therethrough to the upright sides of the metal studs. As with the secondary wallboard strips, secondary wallboard gaps exist between the secondary wallboard wall panels and the ceiling. These secondary wallboard gaps are narrower than the primary wallboard gaps that exist between the primary wallboard wall panels and the ceiling. The primary and secondary wallboard gaps likewise each form an open space or "chair" that receives the strips of the same compressible, nonflammable mineral fiber as in a wall rated to withstand a fire for only one hour. A head-of-wall constructed in this manner meets the applicable two-hour rating for a wall to withstand fire, which is the most stringent fire resistance rating currently in use.

The invention may be described with greater clarity and particularity by reference to the accompanying drawings.

DESCRIPTION OF THE EMBODIMENTS

Figure 1:
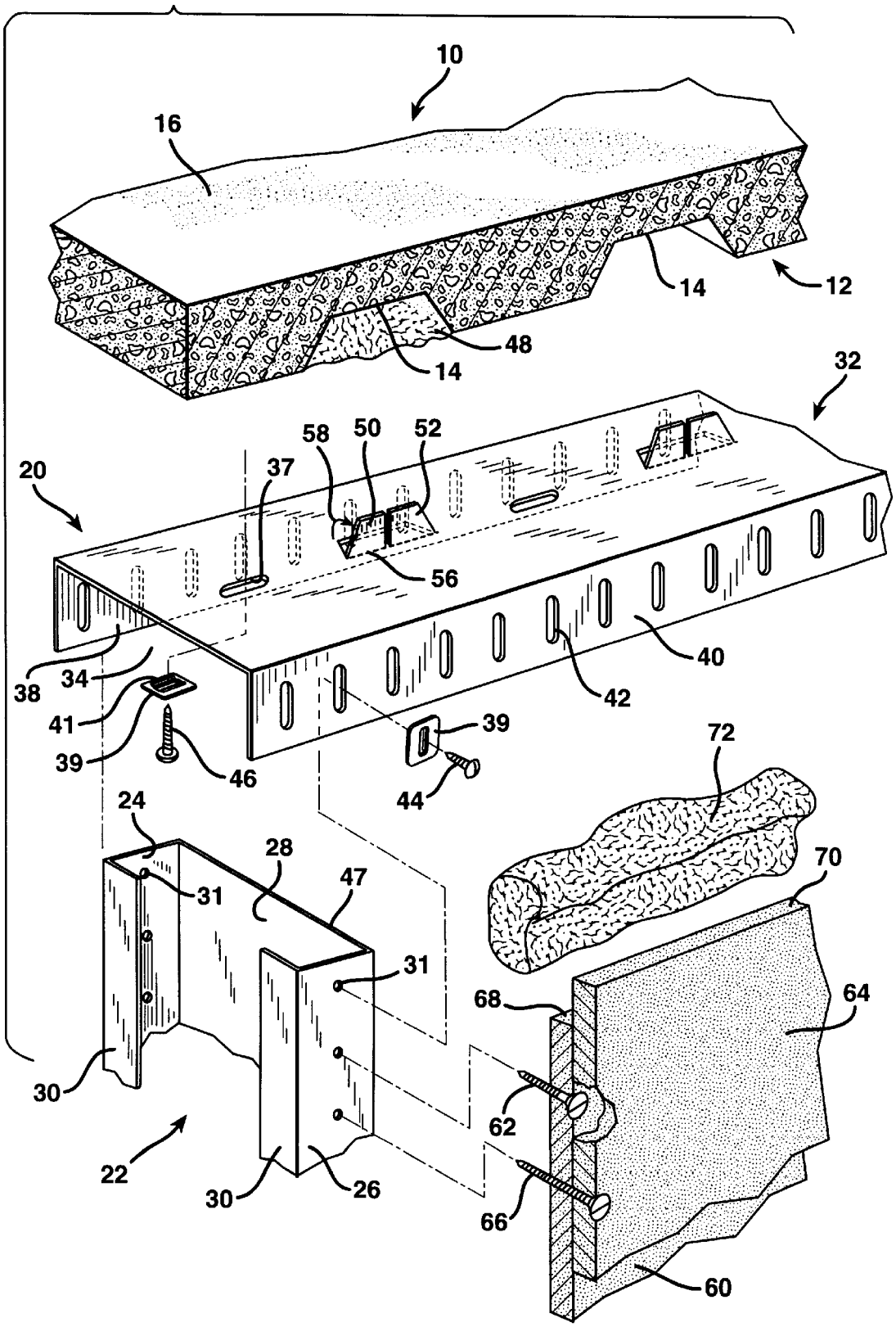
FIG. 1 is a exploded perspective view illustrating a seismic and fire resistant interior head-of-wall structure according to the invention.

FIG. 1 illustrates a portion of a building having a floor about nine feet above which a ceiling is formed. The ceiling is indicated generally at 10 and is formed of an expansive corrugated metal deck member 12 on the underside of which a plurality of concave, downwardly facing, channel-shaped flutes 14 are formed. Each of the flutes 14 is of generally trapezoidal cross section about six inches in maximum width and about three inches in depth. The expansive metal deck member 12 is preferably formed of eighteen gauge W3 galvanized steel fluted decking. The ceiling 10 also includes a layer of reinforced concrete 16 poured thereatop to a minimum thickness of about two and a half inches. The concrete 16 is normal weight and has number four steel reinforcement therein.

Beneath the ceiling 10 there is a seismic and fire-resistant, interior head-of-wall structure indicated generally at 20. The wall culminating in the head-of-wall structure 20 is installed between the floor beneath and the ceiling 10. That wall is formed of a plurality of vertical, metal studs 22, each about one hundred seven and a half inches in height. Each of the metal studs 22 is formed three and five-eighths inch deep from 0.019 inch thick galvanized steel. The metal studs 22 are located twenty-four inches on center, maximum, and are more typically spaced at sixteen inch intervals. Each of the studs 22 is formed from a single sheet metal structure bent into a configuration having stud side walls 24 and 26 of uniform width. The stud side walls 24 and 26 are bent perpendicularly out from a relatively broad, central web 28. The edges of the side walls 24 and 26 remote from the web 28 are turned over to form marginal lips 30 which enhance the structural rigidity of the studs 22. The studs 22 thereby have a generally "C-shaped" cross-section, as illustrated.

The top of the head-of-wall 20 is formed by a beam 32 configured as an inverted, U-shaped structure fabricated from a minimum of sixteen-gauge galvanized steel and defining a downwardly facing channel 34. The beam 32 is comprised of a web 36 disposed in a horizontal plane and a pair of opposing side walls 38 and 40 depending downwardly a distance of two and a half inches from the web 36 in mutually parallel vertical alignment. The width of the web 36 varies from between two and a half and eight inches, depending upon the wall thickness.

The beam side walls 38 and 40 are fabricated with vertically elongated stud fastener openings 42 defined therethrough. The stud fastener openings 42 are each preferably about one and one-quarter inches in length, one-quarter inch in width, and are spaced longitudinally from each other at regular one and one-half inch intervals.

The slots 42 are centered within the side walls 38 and 40 in a vertical direction relative to the web 36.

The studs 22 are very slightly narrower than the beams 32. Therefore, the upright side walls 24 and 26 of the studs 22 fit within the side walls 38 and 40 of the beam 32. The beam 32 extends across the upper ends of the studs 22 so that the side walls 38 and 40 of the beam 32 capture and embrace the sides 24 and 26 of the studs 22, as best illustrated in FIG. 2.

Figure 2:
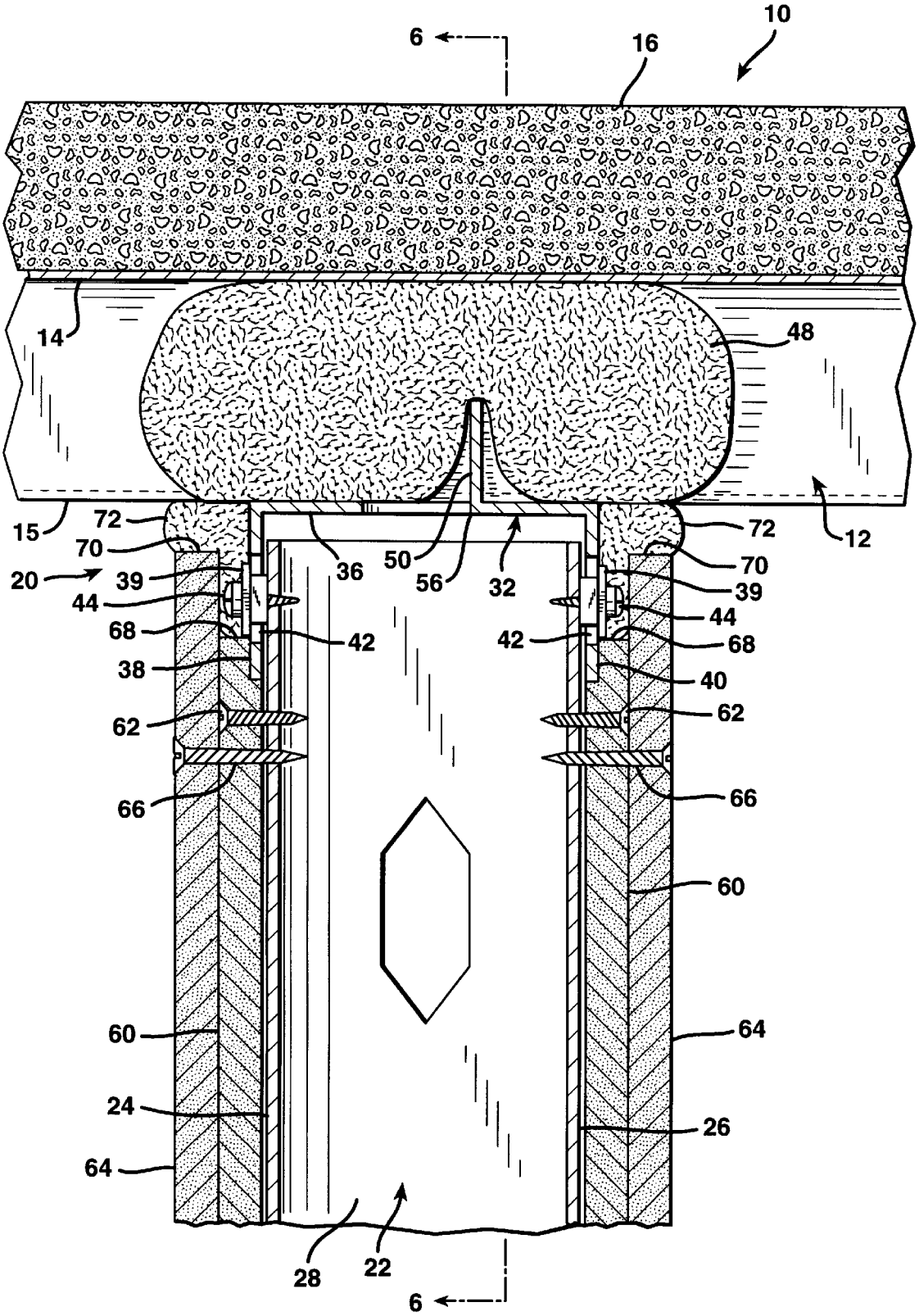
FIG. 2 is a sectional elevational view illustrating the head-of-wall structure of the invention designed for a two-hour fire rating and in which the wall extends perpendicular to the alignment of the ceiling flutes.

As best shown in FIG. 2, the deck 12 makes contact with the beam 32 at its flat surfaces 15 between the flutes 14. Elongated, longitudinal fastening slots 37 are defined in the web 36 of the beam 32 periodically along its length. The slots 37 are each typically about two inches in length. The slots 37 are spaced eight inches on center where the deck 12 has an eight inch flute spacing, and twelve inches on center where the deck 12 has a flute spacing of twelve inches.

Standoff washers 39 are provided for each of the elongated beam fastener slots 37. Each standoff washer 39 is a flat, preferably rectangular structure having an elongated slot defined therein. Standoff washers are preferably about seven-eighths of an inch in width and about three-quarters of an inch in length. The longitudinal slot 41 defined therein is preferably about three-eighths of an inch in length. In the formation of the slots 41 the structure of the standoff washer 39 is deformed so as to provide a pair of ribs or lips that extend out from the otherwise planar structure of the standoff washer 39 a distance of about one-sixteenth of an inch. The lips extend longitudinally along the sides of the elongated slots 41.

The structure and use of the standoff washers 39 is illustrated and described in U.S. Pat. No. 5,467,566, which is incorporated herein by reference. Specifically, a standoff washer 39 is positioned in each of the ceiling fastener slots 37 such that the lips extend up through the web 36, and protrude a very short distance therebeyond.

Ceiling fasteners 46, which may be no. 10 powder actuated fastening screws, are fired from beneath the beam 32 and extend up through the standoff washers 39 positioned at the ceiling fastening slots 37, through the steel deck 12, and into the concrete 16. The ceiling fasteners 46 may be installed at eight or twelve inch intervals along the length of the beam 32, depending upon the spacing of the flutes 14 in the deck 12. The heads of the fasteners 46 bear against the standoff washers 39 to hold the beam 32 up against the ceiling 10. However, since the lips of the standoff washers on both sides of the slots 41 therein contact the surface 15 of the deck 12, and since the slots 37 are greater in length than the length of the lips of the standoff washers 39, a certain amount of longitudinal movement is permitted between the deck 12 and the beam 32 when the head-of-wall 20 is subjected to seismic activity.

The portions of the flutes 14 that pass transversely across the beam 32 and reside directly above the web 36 form cavities in the form of transverse tunnels that are filled with batts of compressible, fire-resistant, mineral fiber safing insulation 48. The mineral fiber insulation batts 48 are preferably cut to twice the width of the deck flutes 14 and to twice the vertical height of the deck flutes 14. The mineral fiber insulation batts 48 are cut to a length equal to the width of a wall stud 22 plus two and a half inches. They preferably extend at least about four and seven-eighths inches along the flutes 14 above the beams 32, as best illustrated in FIG. 2. The batts 48 are packed into the cavities or tunnels formed by the flutes 14 above the beams 32 and extend laterally beyond the web 36 of the beams 32. For example, the mineral fiber insulation batts 48 may extend at least about five-eighths of an inch beyond the side walls 38 and 40 on either side of the beam 32.

As illustrated in the drawings, a plurality of pairs of insulation anchoring tabs 50 and 52 are defined along the length of the beam 32 in the structure of the web 36 at locations beneath the downwardly facing flutes 14 of the metal deck 12 and between the locations of the studs 22. Each of the pairs of insulation anchoring tabs 50 and 52 are formed by a pattern of trapezoidal cuts in the web 36 bifurcated in a transverse direction to create a pair of mirror image, right trapezoidal shaped tabs 50 and 52. At the location of each pair of tabs 50 and 52, the web 36 is cut longitudinally a distance of two inches. At the ends of each longitudinal cut there are a pair of diverging, transverse cuts. At the center of the longitudinal cut there is another transverse cut, which is perpendicular to the longitudinal cut. The cuts are formed so that each of the tabs 50 and 52 has a minor base of about one inch and a major base of about one and one-half inches.

The pairs of tabs 50 and 52 are precut in the stock of sheet metal forming the beams 32, but remain in the plane of the remaining structure of the beam webs 36 until after the beam 32 is attached to the deck 12 by means of the ceiling fastening screws 46 and standoff washers 39 in the manner previously described. Following attachment of the beams 32 to the deck 12, and packing of the insulation batts 48 in the transverse tunnels formed by the flutes 14, the insulation anchoring tabs 50 are inelastically bent up along bending lines 56. These bending lines 56 are parallel to and located opposite the longitudinal die cut lines 54 forming the minor bases of the trapezoidal shaped anchoring tabs 50 and 52. The bending lines 56 are preferably linearly aligned down the longitudinal centers of the beams 32.

The pairs of insulation tabs 50 and 52 are spaced longitudinally along the web 36 of the beam 32 at the same center-to-center intervals as the flutes 14, but midway therebetween. Thus, once the beam 32 has been installed and secured by the ceiling fasteners 46 to the concrete 16, and the insulation batts 48 packed into the cavities above the beam 32, an installer strikes the trapezoidal areas delineated by the die cuts in the beam 32 with a hammer from beneath the underside of the beam 32. This force inelastically bends the insulation anchoring tabs 50 and 52 upwardly, about the lines of bending 56, driving them into to the mineral fiber insulation batts 48 and thereby securing the mineral fiber insulation batts 48 longitudinally within the concave, downwardly facing tunnels formed by the flutes 14.

When the insulation engaging tabs 50 and 52 are bent upwardly out of the plane of the web 36 of the beam 32 in the direction indicted by the directional arrow 58 in FIG. 1, the tabs 50 and 52 are oriented substantially perpendicular to the webs 36. By forming the tabs 50 and 52 as separate structures in pairs, it is easier to bend them with a hammer or other impact tool. When the tabs 50 are bent in this manner they project upwardly into the mineral fiber insulation batts 48. The insulation anchoring tabs 50 and 52 thereby serve to hold the mineral fiber insulation batts 48 within the cavities defined in the flutes 14 directly above the beam 32.

It is important to note that once they are bent the insulation anchoring tabs 50 and 52 are oriented so as to project upwardly in a vertical plane oriented substantially perpendicular to the alignment of the flutes 14. This provides a maximum resistance to pressure acting in a longitudinal direction in the flutes 14.

Once the insulation anchoring tabs 50 and 52 have all been bent upwardly to project into the mineral fiber insulation batts 48, the studs 22 are then fastened to the beam 32. The studs 22 are cut to lengths so that their upwardly facing edges 47 terminate slightly below the web 36 of the beam 32. Preferably, a clearance of about one-half of an inch exists between the upper edges 47 at the tops of the studs 22 and the undersurface of the web 36.

The lower ends of the studs 22 are secured to a sill track in a conventional manner. The upper extremities of the studs 22 are fastened to the side walls 38 and 40 of the beam 32 using standoff washers 39 and one-half inch length, pan head, self drilling or self-tapping no. 6 sheet metal framing screws 44. A standoff washer 39 is positioned at the center of each slot 42 that is aligned with a stud 22. The standoff washer 39 is centered within the slot 42 and placed thereagainst so that the lips on each side of the standoff washer slot 41 project through the structure of the beam 32 forming the side walls 38 or 40. The standoff washer lips project slightly beyond the thickness of the twenty-gauge stock forming the beam 32 so as to reside in contact with the side walls 24 and 26 of each stud 22.

The stud fastening screws 44 are then power driven through the standoff washer slots 41 into the structure of the stud side walls 24 and 26 therebeyond, thereby forming stud fastener openings 31 therein. By securing the studs 22 to the beam 32 in this manner, the studs 22 are securely fastened to the beam 32. Nevertheless, the standoff washers 39 and the vertically elongated slots 42 permit a limited amount of relative vertical movement between the studs 22 and the beam 32, thereby providing resistance to seismic activity. The function of the standoff washers 39 and the stud fastening slots 42 in this regard are described respectively in U.S. Pat. No. 5,467,566 and in U.S. Pat. No. 5,127,203, respectively, both of which are hereby incorporated by reference.

Once the studs 22 have been secured to the beam 32 by means of the stud fastening screws 44, sheets of wallboard are mounted on the studs 22 against both of the sides 24 and 26 thereof to form the interior building wall surfaces. In this connection first sheets 60 of wallboard are secured on both sides of the studs 22. Each of the first wallboard sheets 60 is preferably a three-quarter inch thick sheet of type "X" gypsum board. The first primary, interior wallboard sheets 60 are secured to the side walls 24 and 26 of the studs 22 by no. 6, one-inch "L"-type drywall screws 62. The screws 62 are self-tapping screws that secure the primary drywall sheets 60 flush against and in direct contact with the side walls 24 and 26 of the studs 22. The screws 62 are placed at approximately twelve-inch intervals on center along the length of the stud 22.

The walls depicted in the embodiments illustrated in FIGS. 1–4 each have a two-hour fire rating. In order to achieve this rating it is necessary to apply a secondary wallboard wall panel 64 of type "X" gypsum board over each primary, interior gypsum wallboard panel 60. The secondary layers of wallboard on each side of the head-of-wall 20 are each comprised of a flat, expansive secondary wallboard panel 64 that contacts and completely covers the first inner layer of wallboard formed by the primary wallboard panel 60. The secondary panels 64 are placed against the primary gypsum board panels 60 at each wall surface and fastened to the studs 22 by means of no. 6 one and five-eighths inch length self-tapping, "L-type" drywall screws 66. The drywall screws 66 are also applied at twelve inch increments on center throughout the lengths of the studs 22, midway between the screws 62. The screws 66 thereby pass through both the secondary wallboard panels 64 and the primary wallboard panels 60 and form openings 31 by which they are fastened to the stud sides 24 and 26.

The primary wallboard panels 60 are fastened to and in contact with the upright sides 24 and 26 of the studs 22 such that primary wallboard gaps exist between the upper edges 68 of the primary wallboard panels 60 and the surfaces 15 of the ceiling deck 12. These primary wallboard gaps between the wallboard panels 68 and the ceiling surfaces 15 are preferably about one and a half inches.

The secondary wallboard wall panels 64 are secured throughout to the upright sides 24 and 26 of the metal studs 22 and against the primary wallboard panels 60 such that secondary wallboard gaps exist between the upper edges 70 of the secondary wallboard panels 64 and the ceiling surfaces 15 of the ceiling deck 12. The gaps between the upper wallboard edges 70 and the downwardly facing ceiling surface 15 are narrower than the gaps that exist between the upper edges 68 of the primary wallboard panels 60 and the ceiling surfaces 15. Preferably, the gaps between the secondary wallboard panel upper edges 70 and the ceiling surfaces 15 are about three-quarters of an inch.

Once the wallboard panels 60 and 64 have been fastened to the upright studs 22 as previously described, continuous strips of mineral fiber safing 72 are packed into the spaces between the upper edges 68 and 70 of the wallboard panels 60 and 64 and the bottom surfaces 15 of the deck 12 so as to extend across and reside directly beneath the insulation batts 48 in all of the cavities created by the flutes 14 on both sides of the wall. Each strip of safing 72 preferably has a rectangular configuration in an uncompressed state about two inches wide and about three inches high before it is packed into position in the gaps between the wallboard panels 60 and 64 and the ceiling deck surfaces 15.

The head-of-wall 20 depicted in FIGS. 1–2 was then subjected to a seismic cycling test that surpassed the seismic cycling test specified by Underwriter's Laboratory's Specification 2079. That specification requires twenty cycles of a one-half inch vertical displacement. The system of FIGS. 1–2 was cycled one hundred times at one full inch vertical cycling. Despite the extreme relative movement between the ceiling 10 and the studs 22, the fasteners 44 and 46 on the head-of-wall 20 remained secure, as did the mineral fiber insulation batts 48 and the mineral fiber insulation strips 72.

The gaps between the upper edges 68 and 70 of the primary wallboard panels 60 and the secondary wallboard panels 64 together create open spaces each having the general configuration of an inverted "L". Because the secondary panel 64 projects upwardly beyond the upper edge 68 of the primary wallboard panel 60 a distance of three-quarters of an inch, the mineral fiber strips 72 remained in place in the positions depicted in FIG. 2, and did not become dislodged therefrom despite the repeated cyclical movement of the studs 22 relative to the ceiling 10. Both the mineral fiber insulation strips 72 and the mineral fiber insulation batts 48 were compressed and expanded resiliently with the cyclical movement to which the head-of-wall 20 was subjected.

The wall of FIGS. 1–2 was then subjected to a one hundred twenty minute fire endurance and hose stream test. The purpose of this test was to evaluate the effectiveness of the mineral fiber insulation batts 48 in the cavities formed by the flute 14 directly above the beam 32 as fire stops. The test was conducted in accordance with ASTM E-119, ASTM E-814, CAN 4-S101, CAN 4-115, UBC 43-1, and UBC 43-6 with a minimum positive furnace pressure of 0.15 inches of water at the fire stop elevation. Water under a pressure of 40 psi in a two inch diameter hose was fired at the mineral fiber insulation batts 48 from a distance of twenty feet. The water pressure is selected so as to simulate the pressure of smoke within a room at the fire stop level.

Unlike comparable wall sections in which the unique construction of the head-of-wall 20 was not employed, the wall section, in accordance with the invention as shown in FIGS. 1–2, passed the test standards for fire endurance requirement for one twenty minute "F" and "T" ratings. Accordingly, it became apparent that the insulation strips 72 remained secure in the gaps above the wallboard. The insulation anchoring tabs 50 and 52 stabilized the batts of mineral fiber insulation 48 in the tunnels formed by of the flutes 14 above the beam 32. The tabs 50 and 52 prevented the batts 48 of mineral fiber insulation from being blown laterally out of the flutes 14 by the hose stream.

It is significant that the mineral fiber insulation strips 72 reside in contact with the mineral fiber insulation batts 48 on both sides of the wall formed by the primary and secondary wallboard panels 60 and 64. Since both the strips 72 and the batts 48 are formed of a compressible, spongy, fire-proof material, no channels through which fire and smoke can travel exist across the head-of-wall 20. To the contrary, the head-of-wall 20 passed even the most stringent fire and seismic tests that are currently in use. Thus, the head-of-wall 20 more than surpasses the specifications required for installations in critical public buildings, such as schools and hospitals.

Figure 3:
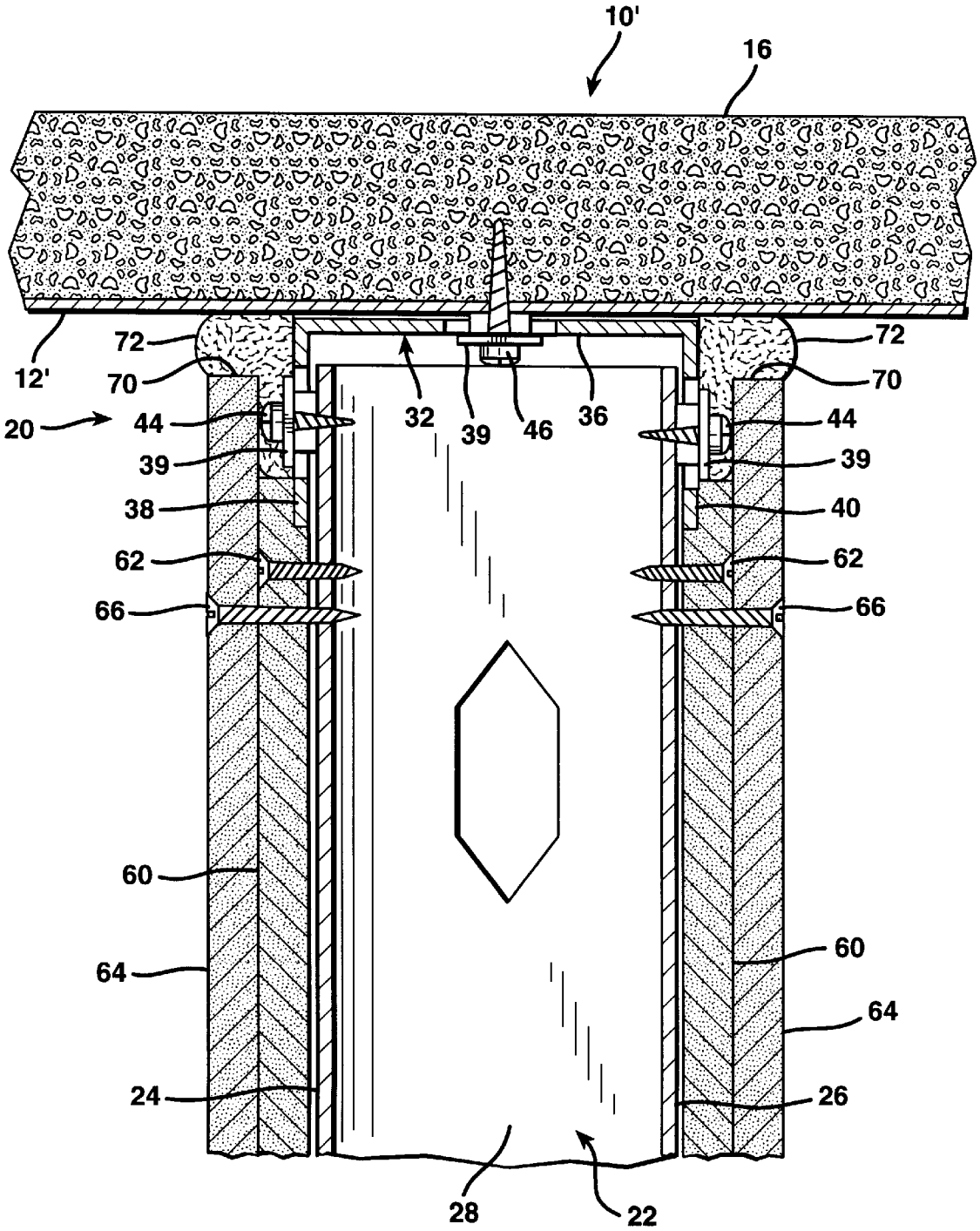
FIG. 3 is a sectional elevational view of a head-of-wall system according to the invention constructed for a two-hour fire rating and in which the wall is located beneath a flat ceiling.

The system of the present invention may also be utilized with flat ceilings as well. FIG. 3 illustrates the head-of-wall 20 as utilized at an interface with a flat ceiling 10' in which concrete 16 is poured on top of a flat deck member 12'.

Figure 4:
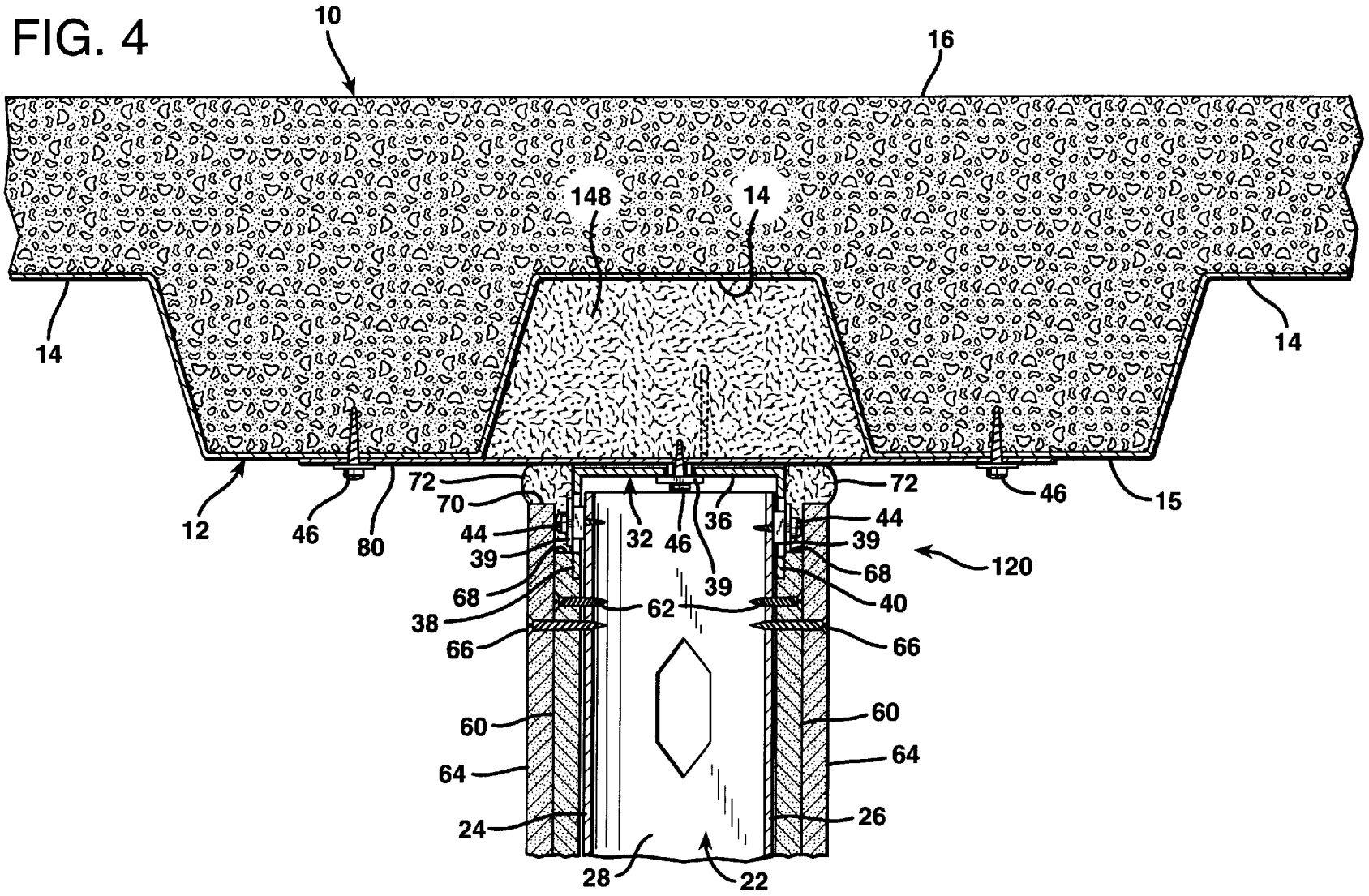
FIG. 4 is a sectional elevational view illustrating the head-of-wall system constructed for a two-hour fire rating and in which the wall is aligned parallel to the flutes in a ceiling deck.

The head-of-wall system of the present invention may also be used in situations in which a wall extends parallel to the flutes of a ceiling 10. FIG. 4 illustrates a head-of-wall 120 having the same construction as that depicted in FIGS. 1–2, but oriented parallel to the flutes 14 and located directly beneath one of those flutes.

In the system of FIG. 4, one of the flutes 14 is located directly above and extends parallel to the beam 32. In this embodiment a long, continuous length of mineral fiber 148, having the same cross sectional dimensions as the batts 48, is disposed within the tunnel formed by the flute 14 directly above the beam 32. The length of mineral fiber insulation 148 originally has dimensions of twice the height of the flute 14 and twice the width of the flute 14 at the transition thereof with the adjacent deck surfaces 15. The length of mineral fiber 148 must therefore necessarily be compressed to fit into the elongated tunnel formed by the flute 14.

The mineral fiber length 148 is packed into the flute 14 and held in position by means of a number of twenty-gauge steel retainer sheets 80 that are preferably about six inches in width and two feet in length. The metal retainer sheets 80 are interposed between the beam 32 and the undersurfaces 15 of the metal deck 12 so as to span the flute 14 beneath which the beam 32 is located. The metal retainer sheets 80 are arranged end to end and are secured to the ceiling 10 by means of ceiling fastener screws 46. The ceiling fastener screws 46 are powder driven up through the retainer sheets 80, through the metal deck 12, and into the concrete 16. The ceiling fastener screws 46 thereby engage the retainer sheets 80 in position so as to hold the length of mineral fiber 148 in the flute 14 located directly above the beam 32. The remaining structure of the head-of-wall 120 is the same as that of the head-of-wall 20, previously described.

Figure 5:
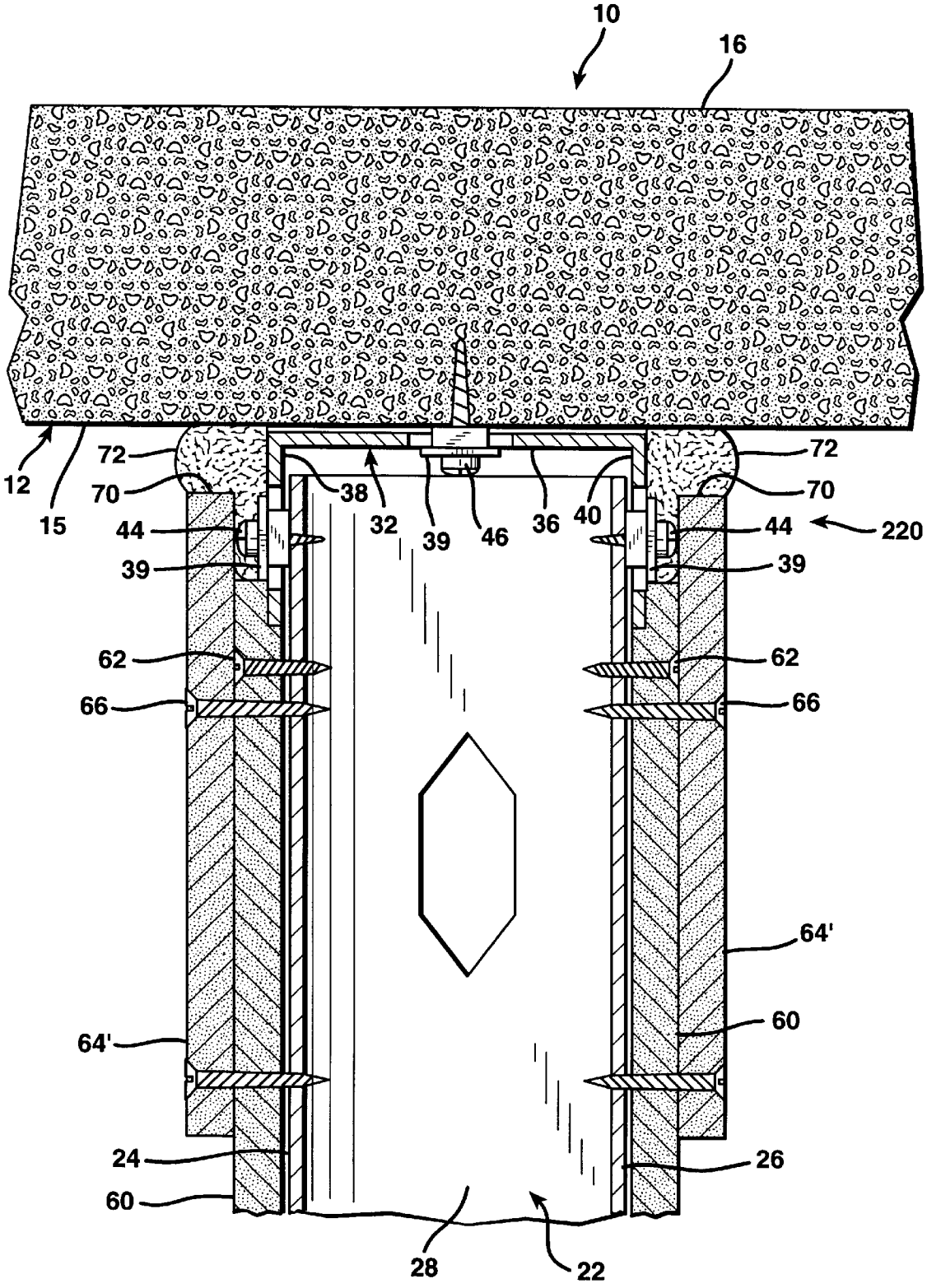
FIG. 5 is a sectional elevational view similar to FIG. 3 for a wall having a one-hour fire rating.
Figure 6:
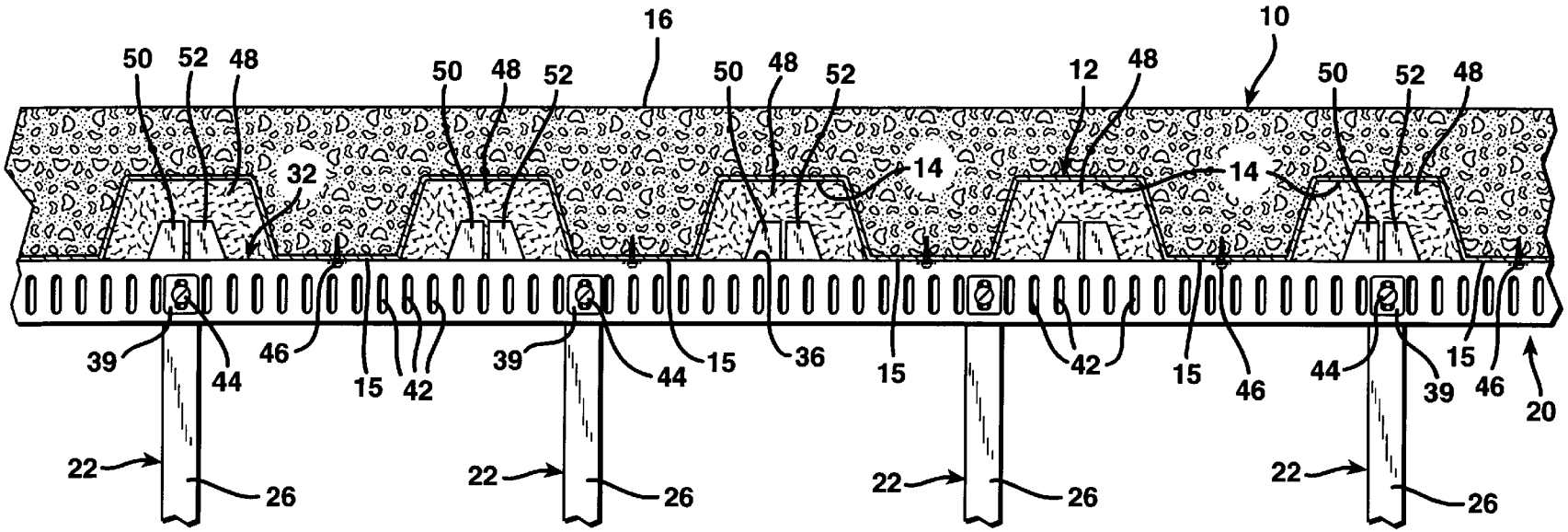
FIG. 6 is a sectional elevation view taken along the lines 6—6 of FIG. 2.

In some situations the building specifications require only a one-hour fire rating for a building wall. FIG. 5 is a view of a head-of-wall 220 comparable to that of the head-of-wall 20 depicted in FIGS. 1–3, but for a wall required to meet only a one-hour fire resistance rating, rather than a two-hour fire resistance rating.

The construction of the head-of-wall 220 differs from that of the head-of-wall 20 only in that secondary, outer wallboard panels are not required to entirely cover the primary wallboard panels 60. Rather, instead of complete panels, secondary wallboard strips 64' are provided to extend across the tops of the primary wallboard panels 60. The second layers of wallboard on the opposing sides of the wall in the head-of-wall 220 are comprised of flat, narrow strips 64' that contact and cover only the upper regions of the first inner layers of wallboard formed by the primary, expansive wallboard panels 60. The secondary wallboard strips 64' are formed of strips of type "X" gypsum board and are eight inches in width. Each secondary wallboard strip 64' is fastened to each of the studs 22 by means of a pair of screws 66 in the manner previously described.

The upper edges of the wallboard strip 64' extend three-quarters of an inch higher than the upper edges of the underlying primary wallboard wall panels 60 so as to form open spaces to receive the continuous strips 72 of mineral fiber safing material which is mounted and disposed in the same manner as in the head-of-wall 20. The integrity of the fire resistance across the top of the head-of-wall 220 is the same as that of the head-of-wall 20. The only difference between the two structures is that with the single sheet of primary wallboard panel 60 throughout most of the height of the wall, only a one-hour fire rating, rather than a two-hour fire rating is achieved.

The present invention provides a unique interaction of elements that greatly enhances the fire resistance capabilities of an interior building wall, yet still retains extraordinary seismic resistant capabilities. The interior wall system of the present invention will withstand seismic testing that meets the most stringent building code seismic resistance specifications due to the use of the standoff washers that fasten the beam to the metal studs and that fasten the beam to the ceiling above, coupled with the elongated slots in the beam that receive the standoff washers and the fasteners that project therethrough.

The building wall system of the invention achieves a fire resistant capability that exceeds even the most stringent code specifications for fire testing due to the unique, compressible, fire resistant insulation material. This compressed mineral fiber material is located in the cavities of the flutes of a conventional fluted metal decking directly above the wall beam. Strips of this same material are applied along the upper edge of the wall. There, these strips are tucked into gaps created to receive them. These gaps are created by an offset between a double thickness of wallboard at the top of the wall. This mineral fiber insulation material is not only fire resistant, but is resiliently compressible, and thus will withstand seismic activity without damage by compression and retraction as required.

Undoubtedly, numerous variations and modifications of the invention will become readily apparent to those familiar with fire retardant and seismic resistant building wall construction. For example, the dimensions and specifications of the panels, fastener types, fastener sizes, fastener spacing, flutes, fastener slots, and anchoring tabs may vary considerably. Accordingly, the scope of the invention should not be construed as limited to this specific embodiments depicted and described.

I claim:

1. In a seismic and fire-resistant interior wall structure installed between a floor and a ceiling, and including a plurality of vertical metal studs extending upwardly from said floor and arranged in linear alignment with each other across said floor, each stud being comprised of a channel having opposing upright sides; a metal, concave, downwardly facing, channel-shaped beam having a web and opposing side walls with vertically elongated stud fastener openings defined therethrough depending from said web, wherein said beam extends across said upper ends of said studs with said web residing in contact with said ceiling and with said side walls of said beam embracing said upright sides of said studs near upper ends thereof; ceiling fasteners extending through said web of said beam to secure said beam to said ceiling; stud fasteners extending through at least some of said stud fastener openings in said beam and into said studs to attach said beam to said upper ends of said studs; and primary wallboard wall panels fastened to and in contact with said upright sides of said studs; the improvement wherein a primary wallboard gap exists between said primary wall board wall panels and said ceiling, and further comprising secondary wallboard wall panels that reside in contact with and cover at least the upper portions of said primary wallboard wall panels and which are secured therethrough to said upright sides of said studs and wherein secondary wallboard gaps exist between said secondary wallboard wall panels and said ceiling which are narrower than said gap that exists between said primary wallboard wall panels and said ceiling, and all of said gaps are filled with compressible, resilient, nonflammable mineral fiber.

2. A wall structure according to claim 1 wherein said ceiling is formed of an expansive metal deck member in which a plurality of concave, downwardly facing channel-shaped flutes are defined, and further comprising insulation disposed in said downwardly facing flutes above said beams; and wherein insulation anchoring tabs are defined in said web of said beam at locations beneath at least one of said downwardly facing flutes of said expansive deck member, and said insulation anchoring tabs are inelastically deformed upwardly to extend up into said insulation above said beams to anchor said insulation relative to said beam.

3. A head-of-wall structure according to claim 2 wherein said insulation anchoring tabs are formed as trapezoidal areas on said web of said beam, each anchoring tab being die cut along three sides, whereby the remaining side of each trapezoidal area serves as a base by means of which said tabs remain connected to the structure of said web.

4. A head-of-wall structure according to claims 2 wherein said insulation in said flutes is comprised of compressible, nonflammable mineral fiber.

5. A head-of-wall structure according to claim 1 further comprising secondary wallboard strips that reside in contact with and extend upwardly beyond said primary wallboard panels so that secondary wallboard gaps exist between said secondary wallboard strips and said ceiling that are narrower than said primary wallboard gaps, and said compressible mineral fiber resides in both said primary and in said secondary wallboard gaps.

6. A head-of-wall structure according to claim 1 wherein said ceiling is formed of an expansive metal deck member in which a plurality of concave, downwardly facing, channel-shaped flutes are defined that extend transversely across said beam to create transverse tunnels thereabove, and quantities of compressible, nonflammable mineral fiber are disposed in each of said transverse tunnels, and further characterized in that insulation anchoring tabs are defined in said web of said beam at each of said transverse tunnels, and said anchoring tabs are bent upwardly into said tunnels, thereby holding said quantities of said mineral fiber in said transverse tunnels.

7. A head-of-wall structure according to claim 1 wherein said ceiling is formed of an expansive metal deck member in which a plurality of concave, downwardly facing, channel-shaped flutes are defined, one of which is located directly above and extends parallel to said beam, and further comprising compressible mineral fiber located in said one of said flutes above said beam, and metal retainer sheets are interposed between said beam and said metal deck so as to span said one of said flutes, and said ceiling fasteners are engaged in said retainer sheets.

8. A head-of-wall structure according to claim 1 further comprising standoff washers interposed between each of said fasteners and said beam.

9. In combination, a building ceiling formed of a metal deck having an exposed undersurface that defines a plurality of mutually parallel, concave downwardly facing flutes with fire insulation disposed within said flutes; channel-shaped, downwardly facing, sheet metal beams for nonload-bearing interior walls, each beam being formed with a horizontally disposed web having a plurality of longitudinally spaced, longitudinally elongated fastener slots defined therein and a pair of side walls depending vertically therefrom and having a plurality of longitudinally spaced, vertically elongated fastener slots defined therein; ceiling fasteners extending through some of said fastener slots in said webs of said beams and into said metal deck to attach said beams to the underside of said metal deck; horizontally disposed stand-off washers interposed between said ceiling fasteners and said webs of said beams to thereby permit limited, relative longitudinal movement therebetween; a plurality of upright, channel-shaped, sheet metal wall studs each having a vertically disposed web between a pair of sides located beneath and extending up into said sheet metal beams with the sides of said studs facing and located between said side walls of said beams; wall stud fasteners extending through some of said fastener slots in said side walls of said beams and into said sides of said upright wall studs to attach said beams to said wall studs; vertically disposed stand-off washers interposed between said wall stud fasteners and said side walls of said beams to permit limited relative vertical movement therebetween; a first inner layer of wallboard secured to and disposed in contact with each of said side walls of said upright wall studs and terminating at its upper extremity beneath the level of said webs of said beams; a second layer of wallboard secured to said side walls of said upright wall studs and in contact with at least the upper portion of said first layer of wallboard and extending above the upper edge thereof and terminating beneath the level of said webs of said beams; and quantities of nonflammable, compressible, resilient safing inserted in between said layers of wallboard and said building ceiling and against said side walls of said beams.

10. A combination according to claim 9 wherein said safing is comprised of mineral fiber.

11. A combination according to claim 10 wherein said second layer of wallboard is comprised of a flat, expansive secondary wallboard panel that contacts and completely covers said first, inner layer of wallboard.

12. A combination according to claim 10 wherein said second layer of wallboard is comprised of a flat, narrow strip that contacts and covers only the upper region of said first, inner layer of wallboard.

13. In a building having a floor with a ceiling located thereabove in which said ceiling is formed by a deck configured to define a multiplicity of concave, downwardly facing flutes, and wherein fire insulation is disposed in said flutes:

a plurality of metal building wall studs arranged in linear alignment with each other, each having opposing, mutually parallel sides extending upwardly from said floor, a horizontally oriented, concave, downwardly facing, channel-shaped, metal beam having a horizontally disposed web with a pair of mutually parallel side walls depending therefrom and embracing said sides of said studs and extending across the upper ends thereof, stud fasteners connecting said side walls of said beam to said sides of said upright studs near the upper ends thereof, ceiling anchors securing said web of said beams to said deck at locations between said flutes, and a first layer of wallboard secured to each of said sides of said wall studs and residing in contact therewith, the improvement comprising:

a first gap defined between said first layer of wallboard and said ceiling, a second layer of wallboard disposed in contact with said first layer of wallboard and extending above the upper extremity thereof to define a second gap narrower that said first gap between said second layer of wallboard and said ceiling, and compressible, resilient, nonflammable mineral fiber disposed in said first and second gaps.

14. A building according to claim 13 wherein said flutes extend transversely across said beam to define tunnels thereabove, and said tunnels are also filled with said mineral fiber.

15. A building according to claim 14 further comprising a plurality of insulation anchors extending from said web of said beam upwardly into said insulation located in said flutes at locations between said beam.

16. A building according to claim 13 wherein said side walls of said beam are provided with longitudinally spaced, vertically oriented slots and standoff washers are mounted in said slots, and said stud fasteners extend through at least some of said slots and through said standoff washers therein and into the structure of said stud walls so as to laterally stabilize said studs relative to said beam and so as to also permit limited relative vertical movement therebetween.

17. A building according to claim 13 wherein said fire insulation in said flutes is mineral fiber.

* * * * *